US005192229A

United States Patent [19]

Clark et al.

[11] Patent Number: 5,192,229

[45] Date of Patent: Mar. 9, 1993

[54] ELECTRICAL CABLE TERMINATION

[75] Inventors: George W. Clark, Irvine; Jens L. List, Jr., Westminster, both of Calif.

[73] Assignee: Sonic Electric, Inc., Paramount, Calif.

[21] Appl. No.: 891,278

[22] Filed: May 29, 1992

[51] Int. Cl.[5] ..... H01R 13/56

[52] U.S. Cl. ..... 439/604; 439/874;736

[58] Field of Search ..... 439/604, 736, 874, 936

[56] References Cited

U.S. PATENT DOCUMENTS 2,289,512 7/1942 McKenney et al. ..... 439/736
4,193,657 3/1980 Slone ..... 439/736 X
4,679,875 7/1987 Ramsey ..... 439/604

*Primary Examiner*—Eugene F. Desmond
*Attorney, Agent, or Firm*—Robert R. Thornton

[57] ABSTRACT

A plug type electrical termination for a multiple conductor armored electrical cable having a hollow connector head filled with high temperature tin-based solder. The electrical conductors pass into one end of the head and extend out the other end through individual bores formed in a cylindrical plug portion, terminating beyond the plug portion in threaded conductor tips, to which conductor terminals are attached. The portion of each conductor within each bore is enclosed in a preselected one of several embodiments, in which the conductor insulation may or may not extend through the bore. In certain embodiments, the individual conductors are enclosed by silver-plated metallic sheaths.

8 Claims, 2 Drawing Sheets

ELECTRICAL CABLE TERMINATION

BACKGROUND OF THE INVENTION

1. Field of the Invention

This present invention relates to terminations for electrical conductors and more particularly, to watertight terminations for multiple conductor armored cables for use with oil well down hole pumps.

2. Description of the Prior Art

U.S. Pat. No. 4,193,657, issued Mar. 11, 1980 to Ralph W. Slone, discloses an armored electrical cable termination suitable for underwater use in oil well recovery operations, in which the electrical conductors of the armored cable are terminated in a metal pot head, from the plug end of which elongated copper terminals extend. Each conductor in the armored cable is fixed to an elongated copper terminal by being soldered to a copper connector which is threaded into the terminal within the pot head. The connectors are held in position by a retainer at the plug end of the pot head. The entire assembly is placed within a mold, which is heated and the pot head filled with a potting material which is polymerizable or vulcanizable to seal the pot head, both at its open end through which the electrical conductors extend and at its plug end so as to enclose the conductors, connectors and retainer, and through which the terminals extend.

SUMMARY OF THE INVENTION

According to the present invention, a plug type electrical termination for a multiple conductor armored electrical cable has a hollow connector head into an open end of which the electrical conductors pass so as to extend through individual bores formed in a cylindrical plug portion extending outwardly from the other head end and terminate beyond the plug portion in threaded conductor tips, to which conductor terminals are attached, with individual enclosing means for enclosing the portion of each conductor within each bore, and with the hollow connector head being filled by a body of high temperature solder, preferably tin-based, so as to close the head open end to hold the electrical conductors fixed within the head and provide a watertight seal thereabout.

BRIEF DESCRIPTION OF THE DRAWING

The plug-type electrical termination for an armored electrical cable with a plurality of electrical conductors therewithin of the present invention is illustrated in the accompanying drawing, in which like numerals indicate like parts, and in which.

DETAILED DESCRIPTION OF THE PREFERRED EMBODIMENT

Figure 1:
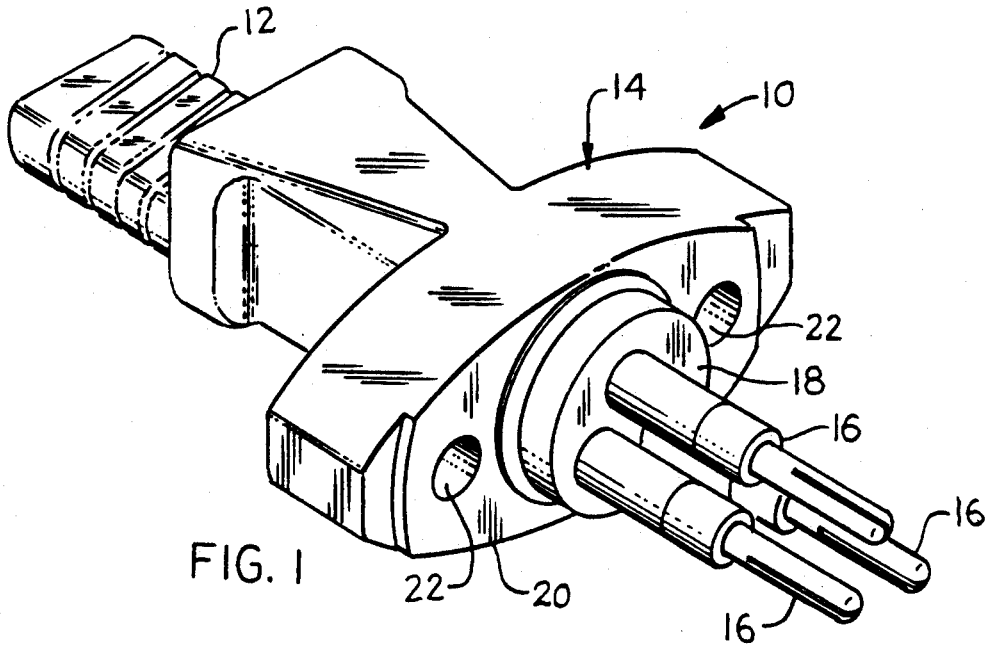
FIG. 1 is a perspective view of a plug-type electrical termination for an armored electrical cable according to the present invention.

Referring now to FIG. 1, there is shown, in perspective, a plug-type electrical termination 10 for an armored cable 12. The termination 10 includes a connector head 14. Three conductor terminals 16 extend from a plug portion 18 of the connector head 14. The connector head 14 has a flange 20 extending outwardly therefrom on two sides of the connector head 14. Fastener bores 22 extend through the flange 20, one on each side of the plug portion 18, for use in fastening the termination 10 to an electrical motor for down hole use in oil well pumping applications, for example.

Figure 2:
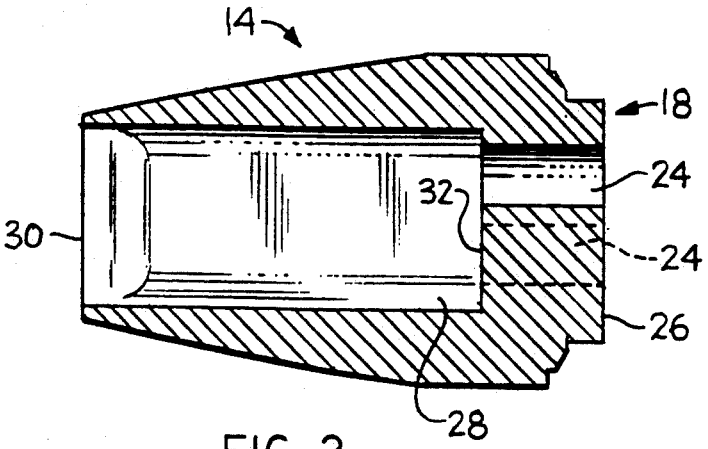
FIG. 2 is a side elevation, in section, of a connector head for use in the termination shown in FIG. 1.

Referring to FIG. 2, the connector head 14 is shown in section. The plug portion 18 has axial bores 24, one of which is shown in dotted lines in FIG. 2, extending from the outer surface 26 of the plug portion 18 through the plug portion 18 so as to open into an interior chamber 28 formed within the head 14. The interior chamber 28 terminates at a head inlet 30 located at the opposite end of the head 14 from the plug 18. The inlet chamber 28 is closed by an inner surface 32 of the plug portion 18.

Figure 3:
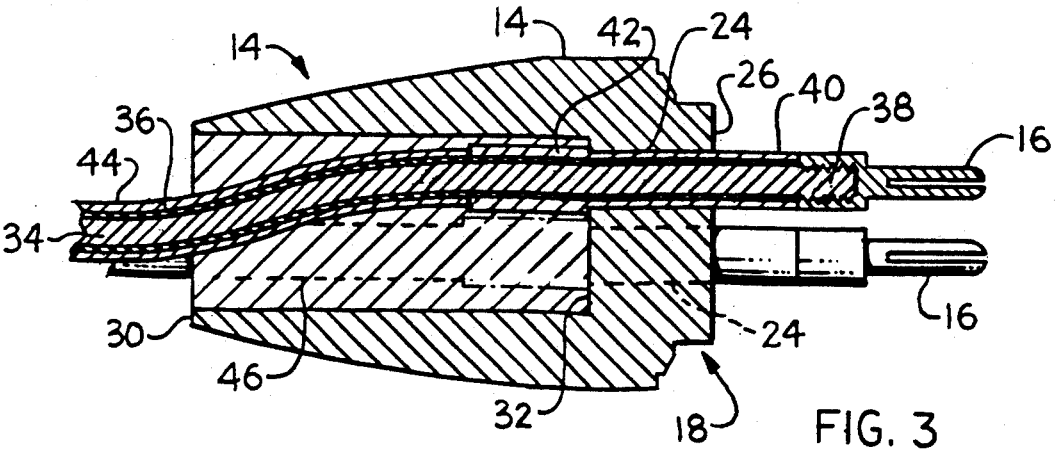
FIG. 3 is a side elevational view, in section, of a termination using the head shown in FIG. 2.

Referring now to FIG. 3, there is shown, in section, a side elevation of the termination 10 shown in FIG. 1. Three electrical conductors 34, only two of which are shown in FIG. 3, are carried within the armored cable. Each of the electrical conductors is enclosed by electrical insulation 36. The electrical conductors and electrical insulation are conventional. Each of the electrical conductors 34 terminates in a threaded tip 38, onto which the conductor terminal 16 is threaded.

In the embodiment shown in FIG. 3, the insulation 36 on the conductor 34 extends through the chamber 28 and the plug portion 18, and terminates externally of the head 14 at the conductor terminal 16. The conductor 34 and insulation 36, as they pass through the bore 24, are enclosed by a ceramic element 40. The ceramic element 40 may be made of any conventional metallized and copper-plated ceramic material utilized to provide for high temperature electrical insulation. As such, the specific composition of the ceramic element does not form a part of the present invention. The ceramic element 40 terminates adjacent the threaded tip 38 coincident with the termination of the insulation 36 thereat, so that the ceramic element provides a smooth interface with the conductor terminal 16.

At the end of the ceramic element 40 opposite the terminal 16, an elongated cylindrical shoulder 42 is formed which abuts the inner surface 32 of the plug portion 18 so as to seat the conductor 34 within the bore 24. The conductor 34 and insulation 36 are enclosed between the armored cable and the ceramic element 40 by metallic sheaths 44, which are preferably stainless steel, although other metals may be used. The portions of the sheaths 44 within the interior chamber 28 of the head 14 are silver plated, in order to provide for ready bonding to the sheaths 44 to a high temperature solder 46. The solder is poured into the interior chamber 28 in order to seal the chamber 28 and fix the position of the conductors and ceramic elements within the chamber 28. The silver plated sheaths 44 terminate at the elongated cylindrical shoulders 42 of the ceramic elements 40, so that the high temperature solder, which serves as potting compound for the termination 10, when solidified, provides a durable water-tight seal of the conductors and associated elements with the connector head 14.

Figure 4:
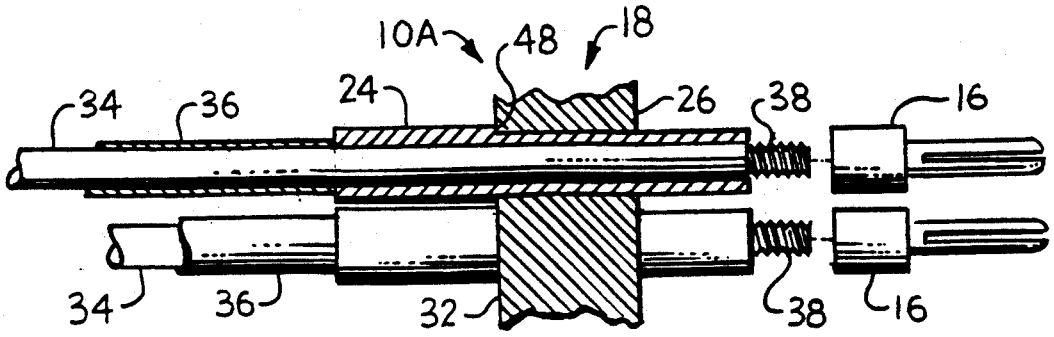
FIG. 4 is a partial side elevational view, partially in section, of an alternate embodiment of termination.

Referring now to FIG. 4, there is shown a partial view, partially in section, of a termination 10A, which is an alternate embodiment of the termination shown in FIG. 3, and in which the metallic sheaths 44 are eliminated. In the termination 10A shown in FIG. 4, the armored cable 12 shown in FIG. 1 may extend into the interior chamber 28 of the head 14 through the inlet 30 and be held in position by the high temperature solder 46. In FIG. 4, as in FIG. 3, the ceramic element 40 is seen to be seated against the inner surface 32 of the plug portion 26 at a face 48 on the shoulder 42.

Figure 5:
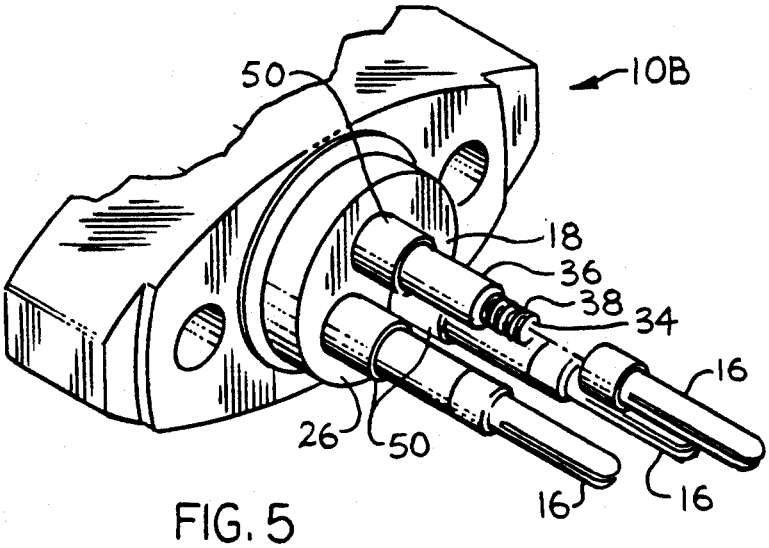
FIG. 5 is a partial perspective view of another alternative embodiment of termination.

Referring now to FIG. 5, there is shown another alternate embodiment of a termination according to the present invention. In FIG. 5, a termination 10B utilizes the metal sheaths referred to above but which, in the embodiment shown in FIG. 5, extend through the plug portion 18. As in FIGS. 1–4, the conductors 34 terminate at the terminals 16 in the threaded tips 38 and the insulation 36 terminates at the commencement of the threaded portions 38. Metallic sheaths 50, similar to the sheaths 44, extend through the plug portion 18 so as to protrude beyond the outer surface 26 thereof, rather than terminating within the interior chamber 28 as do the sheaths 44 shown in FIG. 3.

Figure 6:
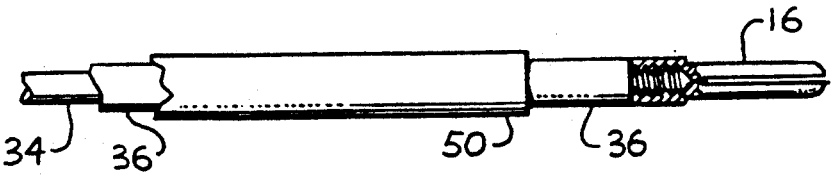
FIG. 6 is a partial view, partially in section, of an insulated electrical conductor and associated components for use in the embodiment of as in FIG. 5.

Referring now to FIG. 6, there is shown, partially in section, a partial view of one of the electrical conductors shown in FIG. 5 to better illustrate the arrangement of the sheath 50 with respect thereto. As is seen in FIG. 6, the sheath 50 terminates short of the conductor terminal 16 so that a portion of the insulation 36 extends beyond the sheath 50 to smoothly interface with the terminal 16. As with the embodiment of FIG. 3, the portion of the sheath 50 within the interior chamber 28 is silver plated in order to assist in the bonding of the high temperature solder 46 to the sheath 50 exterior surface. While the embodiment of FIGS. 5 and 6 is comparatively simple to construct, it relies entirely upon the bonding of the high temperature solder to the sheath in order to form the water-tight seal of the interior chamber and simultaneously hold the conductors 34 fixed within the chamber 28, and so may not be desirable for certain applications.

Figure 7:
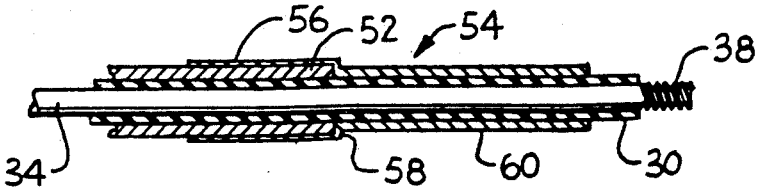
FIG. 7 is a partial side elevational view of another alternate embodiment of conductor and related components for use in the termination of the present invention.

Referring now to FIG. 7, there is shown another alternate embodiment of the components used to engage the conductor 34 as it passes through the bore 24. In FIG. 7, there is shown, partially in section, the conductor 34 and insulation 36 which are identical to their configurations in FIGS. 3, 4, 5, and 6. However, in FIG. 7, a metallic sheath 52, which may be otherwise identical in construction with the sheaths 44 and 50, terminates immediately adjacent the inner surface 32 of the plug portion 18. In the embodiment shown in FIG. 7, rather than having the sheath 52 directly abut the plug portion inner surface 32 in a manner similar to the shoulder 48 on the ceramic element 24 shown in FIG. 4, a metal casing 54 has an expanded cylindrical end portion 56 which encloses the termination of the sheath 52 at a shoulder 58. The shoulder 58 seats against the plug portion inner surface 32 in the same manner as the shoulder 48 on the ceramic element 24 of FIG. 4. The casing 54 has a main body portion 60 which extends through the bore 24 and terminates adjacent the threaded tip 38 so as to provide a smooth inner face with conductor terminal 16.

The term "high temperature solder," as used herein, refers to solders whose melting points are elevated above the usual solder melting point of about 350° C. Such solders are well known, and are usually constituted primarily of tin. Other metals, such as silver or antimony, may be present in amounts as small as about five percent. The particular metals used and their percentages in the solder determine the solder melting point, as is well known in the art. Such solders may have melting points as high as 430° C., or even higher, thereby avoiding termination failure under the temperature conditions which frequently exist at the down hole pump.

The invention claimed is:

1. A plug type electrical termination for an armored electrical cable with a plurality of insulated electrical conductors therewithin comprising:

a hollow connector head open at one end, through which open end said insulated electrical conductors extend into said head, said head having a cylindrical plug portion extending outwardly from the other end of the connector head so as to close said other end, said plug portion having an axial bore extending therethrough for each of said electrical conductors, whereby each of said electrical conductors extends into the head and through a preselected bore of the plug portion so as to terminate beyond the plug portion in an uninsulated threaded conductor tip, to which a conductor terminal is attached;

individual enclosing means for enclosing the portion of each conductor within said bore; and a body of high temperature solder filling said head so as to close said head open end to hold the electrical conductors fixed within the head and provide a water-tight seal thereabout.

2. A termination according to claim 1, and in which the electrical conductor insulation extends through the head plug portion, and in which said individual enclosing means are comprised by individual metallic sheaths enclosing each of said conductors so as to extend from the armored cable into the head and through the head plug portion.

3. A termination according to claim 1, in which the electrical conductor insulation extends through the head plug portion, and in which said individual enclosing means is comprised by a separate metallic sheath enclosing each of said insulated electrical conductors so as to extend from the armored cable into the head and terminate therein, the portions of said sheaths within the head terminating adjacent the plug portion; and including a metallic casing within the head enclosing each termination of each metallic sheath and extending through the plug portion so as to enclose said insulated conductor extending therethrough, each of said casings being seated against the interior of the plug portion by a shoulder formed on the casing where it encloses the sheath termination.

4. A termination according to claim 1, and in which the individual enclosing means is comprised by a separate cylindrical metallized, copper-plated ceramic element enclosing each conductor, each of said ceramic elements having a shoulder which seats against the plug within the head.

5. A termination according to claim 4, and in which the insulation on each electrical conductor terminates within the head at its ceramic element, so that the ceramic element directly abuts the conductor within the bore.

6. A termination according to claim 4, and in which the electrical conductor insulation extends through the bore within the ceramic element so as to separate the conductor from the ceramic element within the bore.

7. A termination according to claim 6, and including a metallic sheath enclosing each of said insulated conductors between the armored cable and the head and extending into the head and terminating at the ceramic elements.

8. A termination according to any of claims 2, 3, or 7, and in which the sheath is silver plated and the high temperature solder is a tin-based solder.

* * * * *